US005483755A

United States Patent [19]

Yang

[11] Patent Number: 5,483,755

[45] Date of Patent: Jan. 16, 1996

[54] METHOD AND APPARATUS FOR DRYING GRAIN MATERIAL

[76] Inventor: Peng-Ta Yang, No. 33, Lane 66, Tailien N. St., Taichung City, Taiwan

[21] Appl. No.: 242,624

[22] Filed: May 13, 1994

[51] Int. Cl.[6] ..... F26B 3/16; F26B 3/06; F26B 17/16

[52] U.S. Cl. ..... 34/514; 34/86

[58] Field of Search ..... 34/513, 514, 519, 34/86, 176, 177; 62/238.6

[56] References Cited

U.S. PATENT DOCUMENTS

| | | | |
|---|---|---|---|
| 2,552,120 | 5/1951 | Scotland | 34/86 |
| 3,299,947 | 1/1967 | Boucraut et al. | 34/86 |
| 4,253,825 | 3/1981 | Fasano | 34/86 |
| 4,973,484 | 11/1990 | Pierik | 34/513 |

FOREIGN PATENT DOCUMENTS

| | | | |
|---|---|---|---|
| 13924 | 6/1914 | United Kingdom | 34/514 |

*Primary Examiner*—Edward K. Look
*Assistant Examiner*—James A. Larson
*Attorney, Agent, or Firm*—Sixbey, Friedman, Leedom & Ferguson

[57] ABSTRACT

A method and an apparatus are provided for drying material such as paddy grains, plastic particles, and the like, which has a plurality of grains. The method includes the steps of providing the grains in a first container, inputting heat into the first container so as to dry the grains therein, delivering the grains from the first container into a second container at a higher position above the first container, delivering the grains from the second container through a heating conduit device into a third container, and conveying air having a temperature lower than that of the third container into the third container so as to refrigerate the grains and remove the moisture therefrom.

7 Claims, 7 Drawing Sheets

METHOD AND APPARATUS FOR DRYING GRAIN MATERIAL

BACKGROUND OF THE INVENTION

1. Field of Invention

The present invention relates to a method and an apparatus for drying material, and more particularly to a method and an apparatus for drying material such as paddy grains, plastic particles, and the like.

2. Related Prior Art

A conventional method and apparatus for drying paddy grains is actuated essentially by combustion reaction and is not able to dry paddy grains entirely and rapidly such that the drying performance is not even and perfect. In addition, during the drying process, moisture remains among the paddy grains, so, the moisture is apt to infiltrate into and percolate through the paddy grains, thereby reducing the drying efficiency. Furthermore, most of the heat energy is not efficiently used, thus causing inefficient utilization of resources. Moreover, waste air and by-products are produced in the combustion process, thereby creating air pollution, thus resulting in environmental hazards.

There will be a more complete and sufficient illustration in the detailed description of the preferred embodiments, concerning the conventional method and apparatus for drying paddy grains.

The present invention has arisen to mitigate and/or obviate the afore-mentioned disadvantages of the conventional method and apparatus for drying paddy grains.

SUMMARY OF THE INVENTION

The primary objective of the present invention is to provide a method and an apparatus for drying a plurality of paddy grains.

Another objective is to provide a method and an apparatus capable of rapidly and evenly drying the paddy grains through a heating conduit means so as to reduce the processing time and increase the drying effect.

A further objective is to provide a method and an apparatus capable Of removing moisture from the paddy grains so as to prevent the moisture from infiltrating into and percolating through the paddy grains.

A further objective is to provide a method and an apparatus capable of efficiently utilizing heat energy, so avoiding waste of energy and inefficient utilization of resources.

A further objective is to provide a method and an apparatus which is not apt to result in air pollution and environmental hazards.

In accordance with one aspect of the present invention, there is provided a method for drying paddy grains. The method includes the steps of providing the paddy grains in a first container, inputting heat into the first container so as to dry the paddy grains therein, delivering the paddy grains from the first container into a second container at a higher position above the first container, delivering the paddy grains from the second container through a heating conduit device into a third container, and conveying air having a temperature lower than that of the third container into the third container so as to refrigerate the paddy grains and remove the moisture therefrom.

In accordance with another aspect of the present invention, there is provided an apparatus for drying paddy grains comprising a circuit means through which freon circulates which comprises an evaporator chamber, a compressor, a condenser, and an expansion valve; a first container in which the paddy grains are provided; a first fan means for transferring heat released by the freon in the condenser into the first container so as to dry the paddy grains therein; a lifting device for delivering the paddy grains from the first container into a second container; a heating conduit means for delivering the paddy grains from the second container into a third container; an outer passage means enclosing a peripheral portion of the heating conduit means and connecting between the compressor and the condenser such that heated freon passes through the outer passage means so as to dry the paddy grains therethrough; and a second fan means for conveying air having a temperature lower than that of the third container from the evaporator chamber into the third container so as to refrigerate the paddy grains therein and remove the moisture from the paddy grains.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 7:
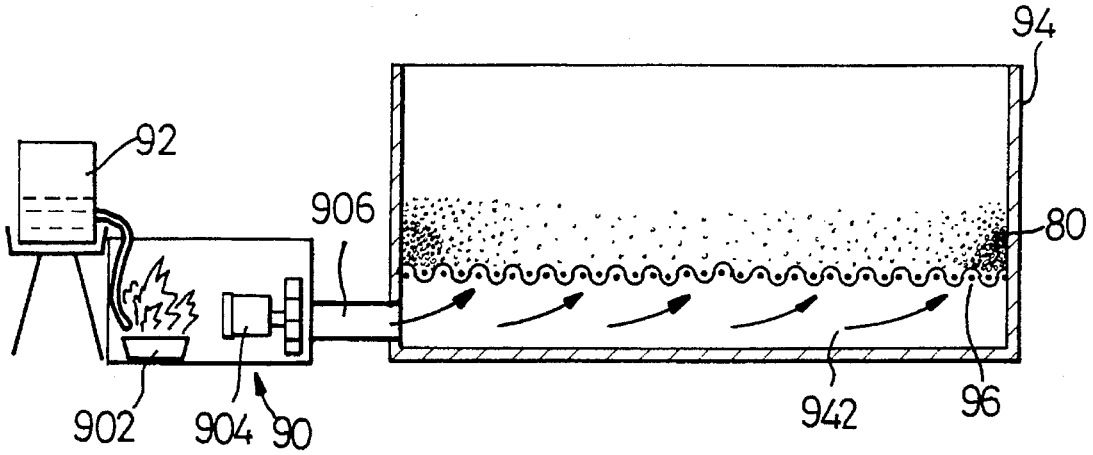
FIG. 7 PRIOR ART
FIG. 7 is a front plan cross-sectional view of a conventional apparatus for drying paddy grains in accordance with the prior art.

For a better understanding of the features and benefits of the present invention, reference is made to FIG. 7 illustrating a conventional method and apparatus for drying a plurality of paddy grains 80 in accordance with the prior art. The paddy grains 80 are provided on a porous mesh 96 which is mounted in a container 94 so as to define a ventilation chamber 942 under the porous mesh 96. An amount of fuel is received in an oil tank 92 and is delivered through a connecting tube into a combustion chamber 90 to react with a ignition device 902 for producing heat energy. A fan means 904 is mounted in the combustion chamber 90 for transferring heated air through a communicating tube 906 into the ventilation chamber 942 of the container 94 for drying the paddy grains 80 in the container 94.

By such an arrangement, the paddy grains 80 are not entirely dried because the heat energy is not easy to be conducted to those paddy grains 80 on an upper position such that the drying effect is not even and such that the time required to wholly dry the paddy grains 80 is protracted. In addition, during the drying process, moisture remains among the paddy grains 80, so, the moisture is apt to infiltrate into and percolate through the paddy grains 80, thereby reducing the drying effect. Furthermore, the heat energy transferred by the fan means 904 into the ventilation chamber 942 is simply part of the heat energy produced in the combustion process. Most of the heat energy is lost in the air, thus causing inefficient utilization of resources. Moreover, waste air and by-products are produced in the combustion process so as to create air pollution, thus resulting in environmental hazards.

Figure 1:
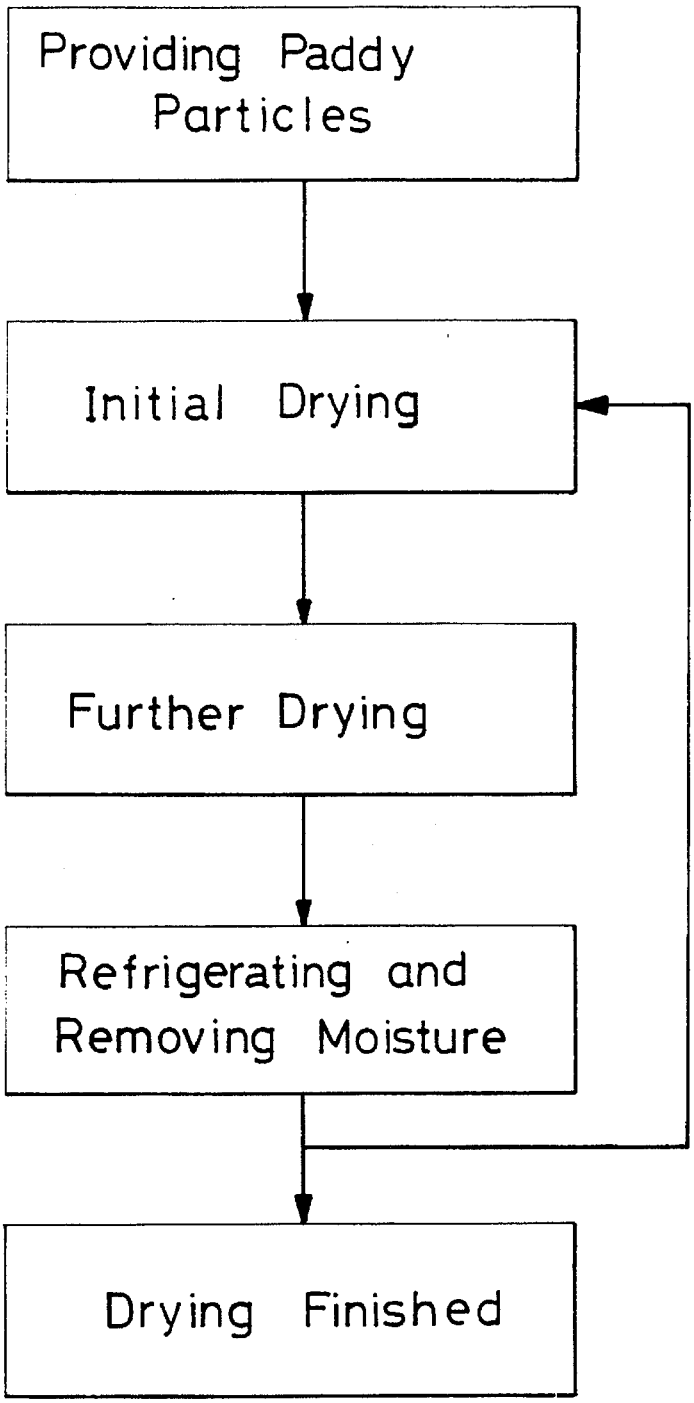
FIG. 1 is a flow chart showing a process for drying and refrigerating paddy grains in accordance with the present invention.
Figure 2:
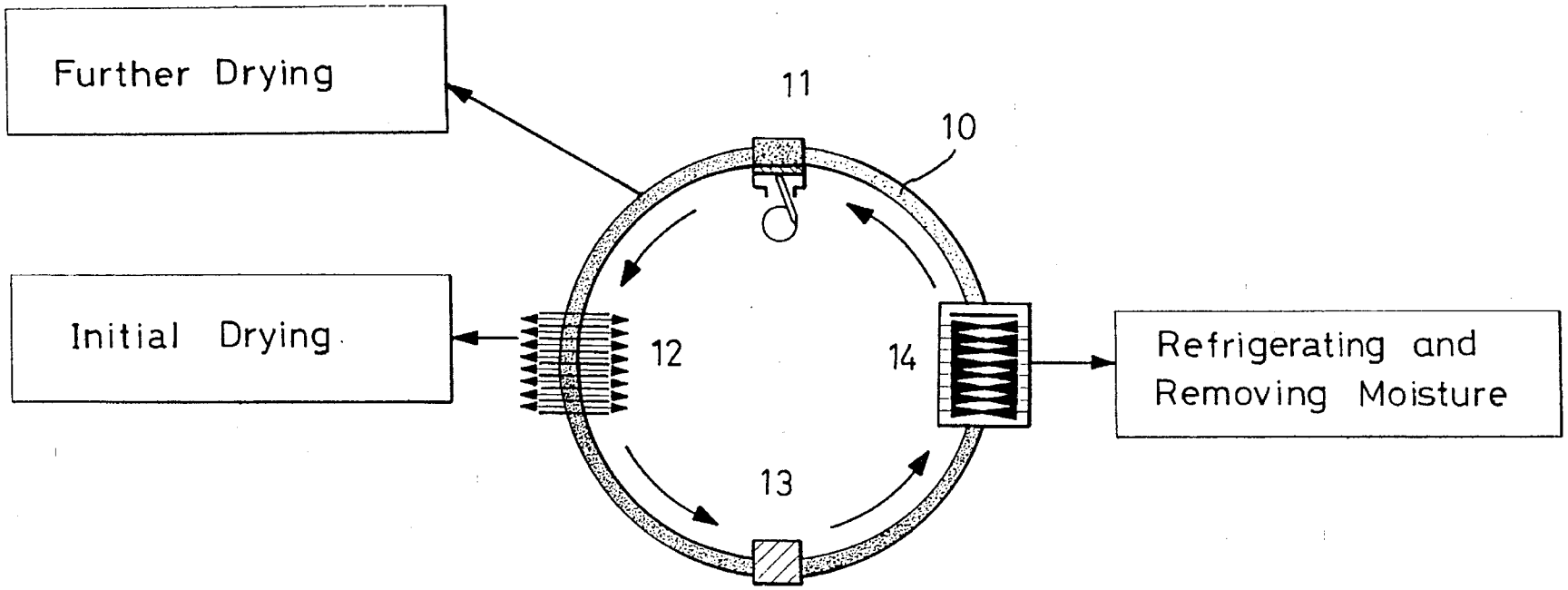
FIG. 2 is a flow chart showing the action process of a circuit means in accordance with the present invention.

Referring to FIG. 1, a method in accordance with the present invention is provided for drying a plurality of paddy grains. The method comprises providing the paddy grains in a first container, inputting heat into the first container so as to dry the paddy grains therein, delivering the paddy grains from the first container into a second container, then conveying the paddy grains through a heating conduit means for further drying, finally transporting the paddy grains into a third container, and conveying air having a temperature lower than that of the third container into the third container so as to refrigerate the paddy grains and remove the moisture therefrom, thus finishing the drying and refrigerating process.

Referring to FIGS. 2–5, an apparatus in accordance with a first embodiment of the present invention is provided for drying a plurality of paddy grains 80. Particularly referring to FIG. 2, the apparatus comprises a circuit means through which freon 10 circulates comprising an evaporator chamber 14 for evaporating the freon 10, a compressor 11 for pressurizing the freon 10, a condenser 12 for condensing the freon 10, and an expansion valve 13 for depressurizing the freon 10. The freon 10 is initially in liquid phase with a low pressure and is evaporated into gas through the evaporator chamber 14. During the evaporating process, the freon 10 is apt to absorb heat from surroundings such that the air enclosing the evaporator chamber 14 is in a low-temperature status. The freon 10 is then pressurized through the compressor 11 such that the freon 10 has a high pressure and temperature before entering the condenser 12. The freon 10 is capable of releasing heat into surroundings through the condenser 12. The freon 10 is then depressurized through the expansion valve 13 and finally returns to the evaporator chamber 14 and thus completes the cycle.

Figure 3:
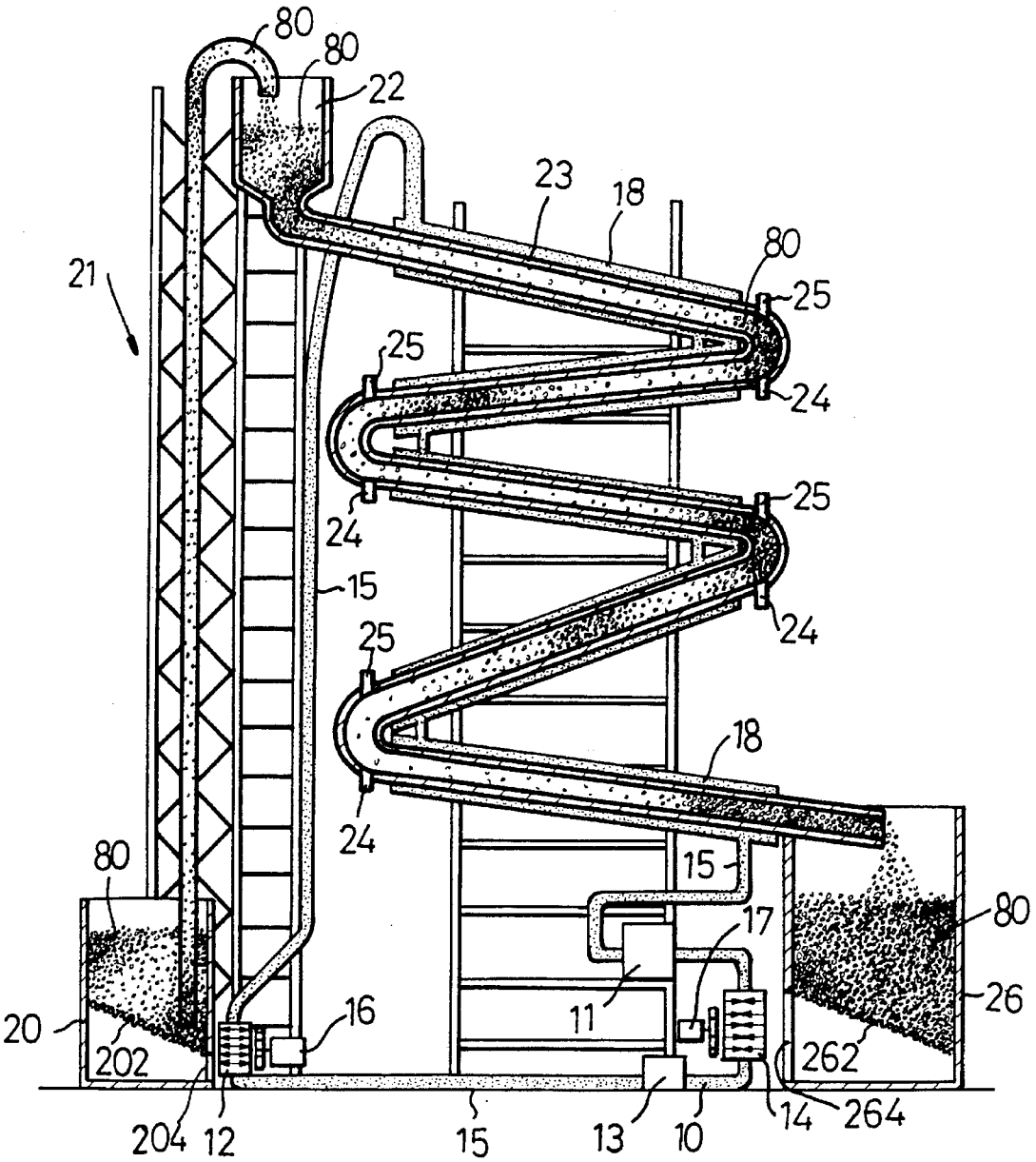
FIG. 3 is a front plan cross-sectional view of an apparatus for drying paddy grains in accordance with a first embodiment of the present invention.
Figure 4:
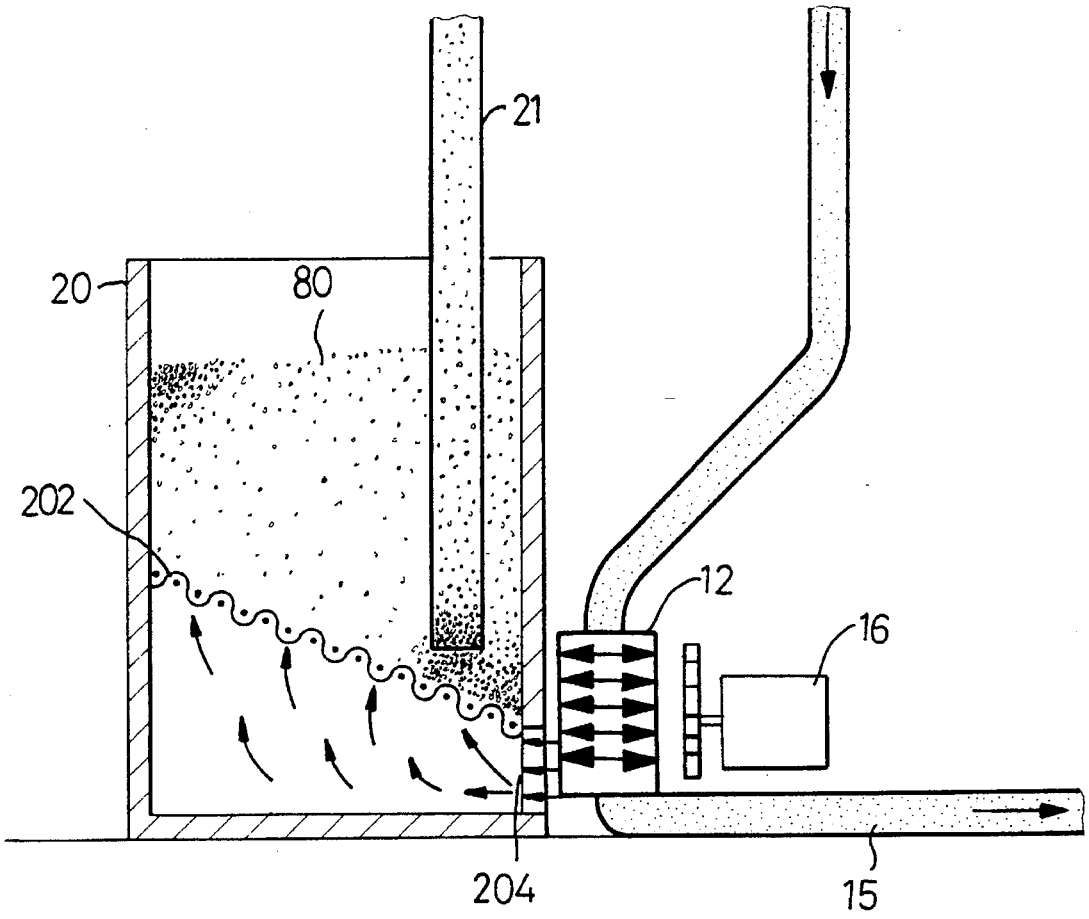
FIG. 4 is a partially enlarged cross-sectional view of the apparatus as shown in FIG. 3, showing the initial drying process.

Referring to FIGS. 3 and 4, the paddy grains 80 are initially received in a first container 20 which has a first ventilator 204 and are disposed on a first porous mesh 202 which is mounted in the first container 20. A first fan means 16 is provided for transferring heat released by the freon 10 in the condenser 12 through the first ventilator 204 into the first container 20 so as to dry the paddy grains 80 therein. The paddy grains 80 are then delivered by a lifting device 21 from the first container 20 into a second container 22 at a higher position above the first container 20.

A heating conduit means 23 is connected with the second container 22 for delivering the paddy grains 80 from the second container 22 into a third container 26 and for drying the paddy grains 80. The third container 26 has a second porous mesh 262 mounted therein on which the paddy grains 80 are disposed and has a second ventilator 264. An outer passage means 18 enclosing a peripheral portion of the heating conduit means 23 is connected between the compressor 11 and the condenser 12 through a connecting tube 15 such that the freon 10 with a high temperature passes through the outer passage means 18 so as to dry the paddy grains 80 through the heating conduit means 23. It is to be noted that the heating conduit means 23 has a plurality of air vents 25 for discharging moist air and has a plurality of water drains 24 for discharging water condensed from the paddy grains 80.

Figure 5:
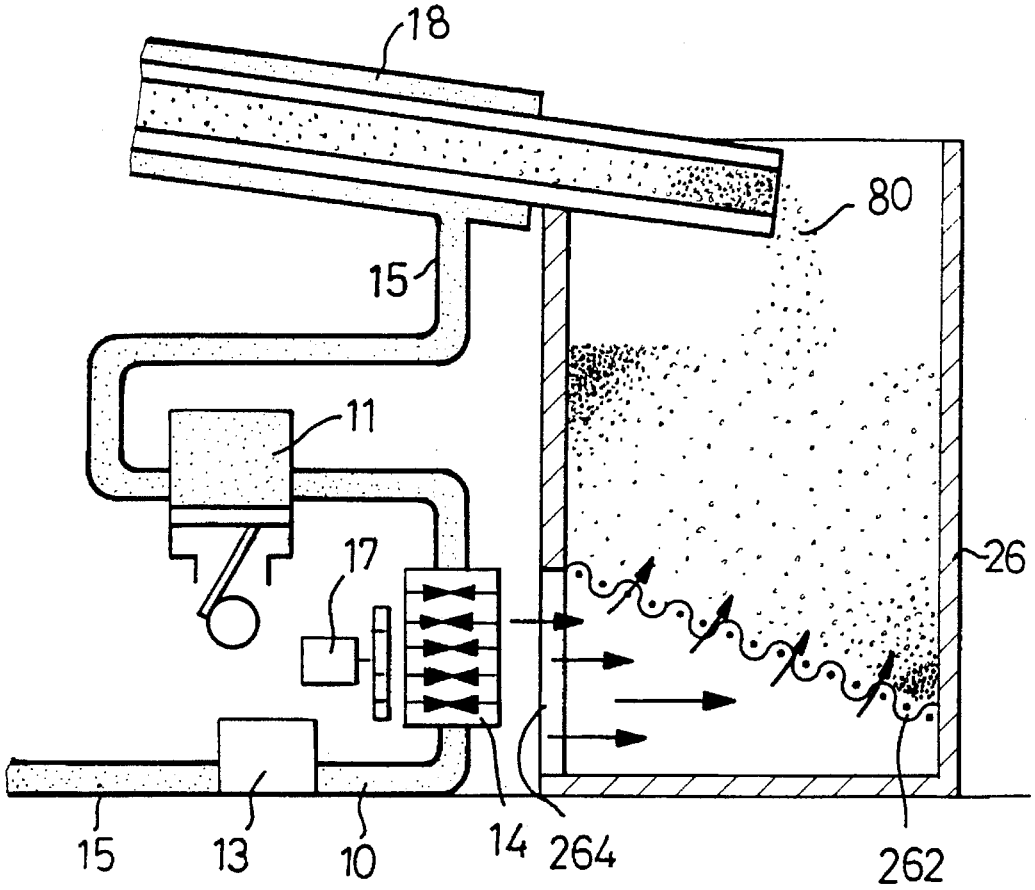
FIG. 5 is a partially enlarged cross-sectional view of the apparatus as shown in FIG. 3, showing the refrigerating process.

Referring to FIGS. 3 and 5, a second fan means 17 is provided for conveying air with a temperature lower than that of the third container 26 from the evaporator chamber 14 through the second ventilator 264 into the third container 26 so as to refrigerate the paddy grains 80 therein and remove the moisture from the paddy grains 80.

Figure 6:
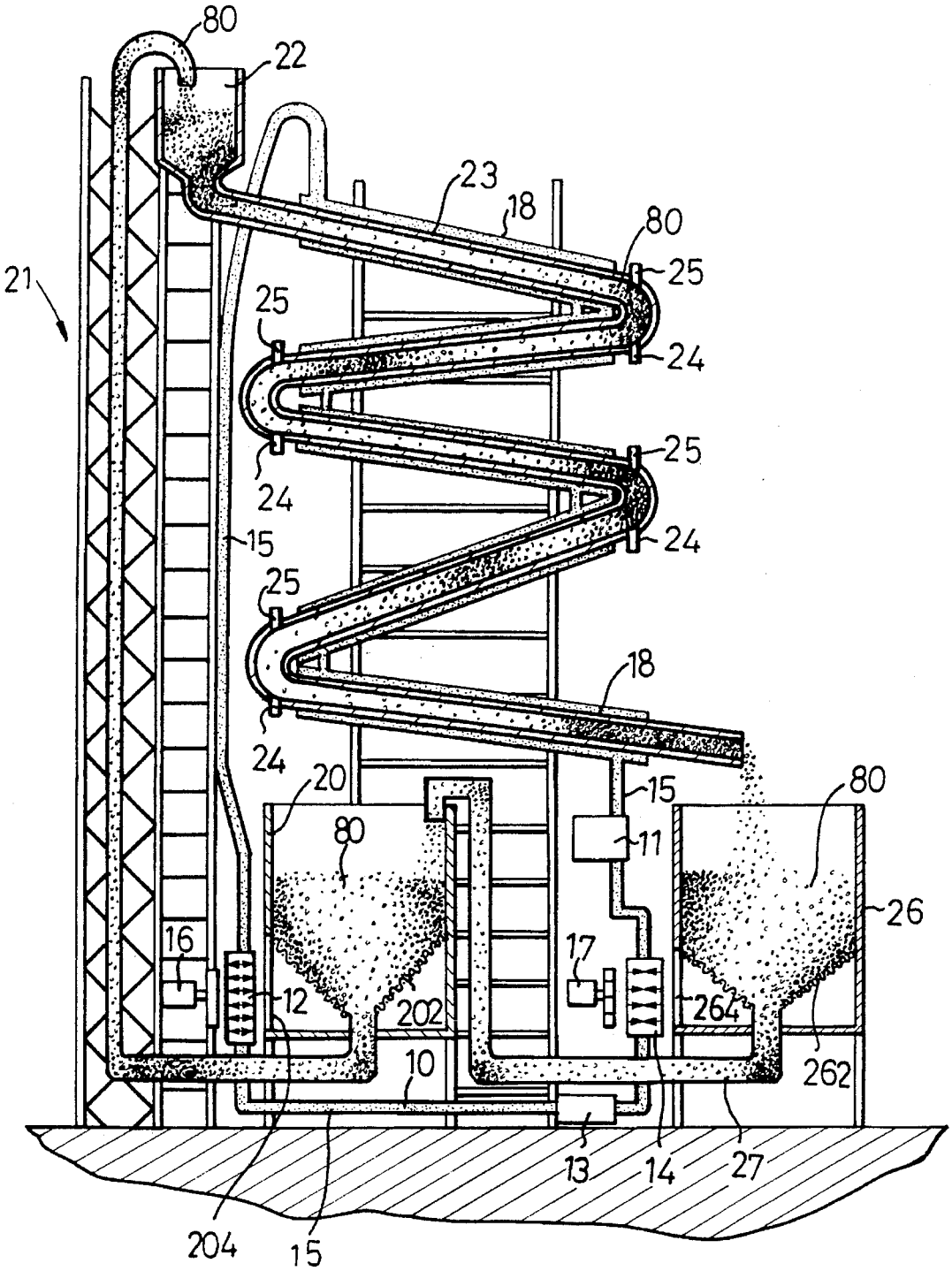
FIG. 6 is a front plan cross-sectional view of an apparatus for drying paddy grains in accordance with a second embodiment of the present invention.

Referring to FIGS. 6, in accordance with a second embodiment of the present invention, a communicating tube 27 is connected between the first container 20 and the third container 16 for repeatedly and circulatively drying and refrigerating the paddy grains 80.

Accordingly, by such an arrangement, a method and apparatus in accordance with the present invention has the following advantages and benefits:

(1) the paddy grains are rapidly and evenly dried by delivering the paddy grains through the heating conduit means so as to reduce the processing time and increase the drying effect.

(2) The moisture is entirely removed from the paddy grains in the refrigerating process of the third container so as to prevent the moisture from infiltrating into and percolating through the paddy grains.

(3) The heat energy released from the freon in the condenser is efficiently utilized to dry the paddy grains, so avoiding waste of energy and inefficient utilization of resources.

(4) There is no waste air and by-products produced in the drying process, so avoiding resulting in air pollution and environmental hazards.

It should be clear to those skilled in the art that further embodiments of the present invention may be made without departing from the teachings of the present invention.

I claim:

1. A method for drying material having a plurality of grains (80) comprising the steps of:

providing a plurality of grains (80) in a first container (20);

inputting heat into said first container (20) so as to dry said grains (80) therein;

delivering said grains (80) from said first container (20) into a second container (22) at a higher position above said first container (20) through a lifting device (21);

delivering said grains (80) from said second container (22) through a heating conduit means (23) for drying said grains (80) and into a third container (26); and conveying air having a temperature lower than that of said third container (26) into said third container (26) so as to refrigerate said grains (80) and remove the moisture therefrom.

2. The method for drying material having a plurality of grains (80) in accordance with claim 1, further comprising the step of:

conveying freon (10) to circulate through a circuit means which comprises an evaporator chamber (14), a compressor (11), a condenser (12), and an expansion valve (13);

transferring heat released by said freon (10) in said condenser (12) into said first container (20) by a first fan means (16) so as to dry said grains (80) in said first container (20);

mounting an outer passage means (18) enclosing a peripheral portion of said heating conduit means (23) and connecting between said compressor (11) and said condenser (12) such that heated freon (10) passes through said outer passage means (18) so as to dry said grains (80) in said heating conduit means (23); and conveying air having a temperature lower than that of said third container (26) from heat exchange relationship with said evaporator chamber (14) into said third container (26) by a second fan means (17) so as to refrigerate said grains (80) and remove the moisture therefrom.

3. An apparatus for drying material having a plurality of grains (80) comprising:

a circuit means through which freon (10) circulates comprising an evaporator chamber (14) for evaporating said freon (10), a compressor (11) for pressurizing said freon (10), a condenser (12) for condensing said freon (10), and an expansion valve (13) for depressurizing said freon (10);

a first container (20) in which said grains (80) are provided;

a first fan means (16) for transferring heat released by said freon (10) in said condenser (12) into said first container (20) so as to dry said grains (80) therein;

a lifting device (21) for delivering said grains (80) from said first container (20) into a second container (22) at a higher position above said first container (20);

a heating conduit means (23) for delivering said grains (80) from said second container (22) into a third container (26);

an outer passage means (18) enclosing a peripheral portion of said heating conduit means (23) and connecting between said compressor (11) and said condenser (12) such that heated freon (10) passes through said outer passage means (18) so as to dry said grains (80) through said heating conduit means (23); and a second fan means (17) for conveying air having a temperature lower than that of said third container (26) from heat exchange relationship with said evaporator chamber (14) into said third container (26) so as to refrigerate said grains (80) therein and remove the moisture from said grains (80).

4. The apparatus for drying material having a plurality of grains (80) in accordance with claim 3, wherein said heating conduit means (23) has a plurality of air vent means (25) for discharging moist air.

5. The apparatus for drying material having a plurality of grains (80) in accordance with claim 3, wherein said heating conduit means (23) has a plurality of water drain means (24) for discharging water.

6. The apparatus for drying material having a plurality of grains (80) in accordance with claim 3, further comprising a porous mesh means (202) mounted in said first container (20), said grains (80) being disposed on said porous mesh means (202).

7. The apparatus for drying material having a plurality of grains (80) in accordance with claim 3, further comprising a porous mesh means (262) mounted in said third container (26).

* * * * *